United States Patent [19]

Scott et al.

[11] Patent Number: 5,042,961

[45] Date of Patent: Aug. 27, 1991

[54] ROOF BOLT WITH HELICAL COIL AND BAIL ANCHOR

[75] Inventors: Ralph F. Scott, Findlay Township; Frank M. Locotos, Peters Township, both of Pa.

[73] Assignee: H & S Machine & Supply Co., Inc., Coraopolis, Pa.

[21] Appl. No.: 366,584

[22] Filed: Jun. 15, 1989

[51] Int. Cl.[5] ..... E21D 20/08

[52] U.S. Cl. ..... 405/261; 411/902

[58] Field of Search ..... 405/259-261; 411/902

[56] References Cited

U.S. PATENT DOCUMENTS

| | | | |
|---|---|---|---|
| 4,100,748 | 7/1978 | Hansen | 405/259 |
| 4,187,040 | 2/1980 | Donan | 405/261 X |
| 4,206,060 | 6/1980 | Yamamoto et al. | 411/902 X |
| 4,556,344 | 12/1985 | White | 405/261 |
| 4,619,559 | 10/1986 | Norris | 405/259 |
| 4,746,248 | 5/1988 | Lillis et al. | 405/260 |
| 4,861,198 | 8/1989 | Stankus | 405/261 |

OTHER PUBLICATIONS

H. N. Maleki et al., "Tension-Torque Relationship for Mechanical Anchored Roof Bolts", Proceedings of the 4th Conference of Ground Control, 7-1987.

Anil Mahyera et al., "Controlled Thrust and Torque Placement of Mechanical Anchor Bolts And Their Relationship to Improved Roof Control", 7-1985.

*Primary Examiner*—Dennis L. Taylor

*Assistant Examiner*—Arlen L. Olsen

*Attorney, Agent, or Firm*—Webb, Burden, Ziesenheim & Webb

[57] ABSTRACT

A mine roof anchor assembly usable with a quick-setting resin cartridge inserted into a mine roof opening includes a partially threaded elongated bolt having a head at one end, a bail-type mechanical anchor at the threaded end, and an elongated helical coil having an upper end attached to the bolt and positioned external of and surrounding a substantial length along the bolt. A bearing plate and a two-faced washer can be positioned on the bolt head. Both sides of the washer may be coated with a dry lubricant such as graphite suspended in a resin base.

9 Claims, 1 Drawing Sheet

ROOF BOLT WITH HELICAL COIL AND BAIL ANCHOR

BACKGROUND OF THE INVENTION

1. Field of the Invention

This invention relates to roof bolts and, more particularly, to a roof bolt which is positioned in a bore hole drilled in a rock formation in a mine roof and which is held in place within the bore by both a mechanical anchor and a quick-setting resin.

2. Description of the Prior Art

It is a well-established practice in underground mining work, such as coal mining, tunnel excavation or the like, to reinforce or support the mine roof to prevent rock falls or cave-ins. The most common means presently used to support mine roofs is an elongated bolt or bar which is inserted into the rock formation above the mine roof in a bore hole and which is securely fixed to the bore hole by an anchoring means such as a mechanical anchor, a quick-setting resin which surrounds the end of the bolt within the hole, or both. The roof bolt, placed under the tension, is used to hold a metal support plate in close engagement with the roof.

The roof bolt described in U.S. Patent No. 4,655,645 combines the features of a mechanical anchor and resin bonding but also provides positive and complete mixing of the resin components by an additional mixing mechanism. This arrangement is relatively inexpensive and easy to manufacture, forces the resin upwards along the bolt during mixing, more violently mixes the resin for a shorter mix time, and eliminates the use of a two-position coupling or delay mechanism. While this arrangement functions very well in hard rock-like formations, it has been found to be less effective in soft strata.

It is an object of the present invention to provide a roof bolt arrangement which has all of the advantages of the roof bolt disclosed in U.S. Patent No. 4,655,645, yet which is effective in the soft strata type of mine formation.

SUMMARY OF THE INVENTION

Our invention is a mine roof anchor assembly usable with a quick-setting resin cartridge inserted into a mine roof opening. The anchor assembly includes an elongated bolt having a head at one end and threaded for a portion of its length at its other end. A bail-type of mechanical anchor is carried at the threaded end. The bail-type mechanical anchor includes an expansion member and a wedge member. The expansion member has diametrically opposed parts and a connecting member having spaced legs and a base. Lower ends of each of the legs are connected to a respective upper portion of the opposed part. The base is joined to the upper ends of the legs. The wedge member is threadedly engaged with the elongated bolt between the legs of the connecting member and the opposed parts of the expansion member. The wedge will force the opposed parts outwardly with respect to longitudinal movement thereof as the bolt is rotated.

An elongated helical coil has an upper end attached to the bolt; the coil is positioned externally of and surrounds a substantial length along the bolt shaft. Further, the coil is positioned below the mechanical anchor. The coil has a direction of coil which urges resin upwardly towards the threaded end while the wedge moves downwardly and while the bolt shaft is rotated in one continuous direction. This achieves mixing of the resin to secure the mechanical anchor to the rock. Thus, when the quick-setting cartridge is ruptured by the base of the bail as it is forced upwardly into the mine roof opening, resin gravitates downwardly between the wall of the opening and the bolt. Rotation of the bolt causes the wedge to move down the shaft and causes the opposed parts of the expansion member to move outwardly and secure into the bore hole wall.

The helical coil can be formed in the shape of a loop which surrounds and is crimped to the bolt shaft at the base of the threads. Preferably, the loop is loosely crimped to the bolt whereby if the wedge comes into contact with the loop, the coil will become uncrimped so as to not impede longitudinal movement of the wedge.

The anchor bolt assembly can further include a bearing plate having a central opening that is positioned on the bolt to engage with a face of the rock formation and a two-faced washer that is positioned on the bolt between the bolt head and the bearing plate.

Preferably, the washer includes a coating formed of a dry lubricant suspension, such as graphite suspended in a resin-based system having about 30%–50% suspended solids by weight. The washer can be made of hardened steel.

DETAILED DESCRIPTION OF THE PREFERRED EMBODIMENT

Figure 1:
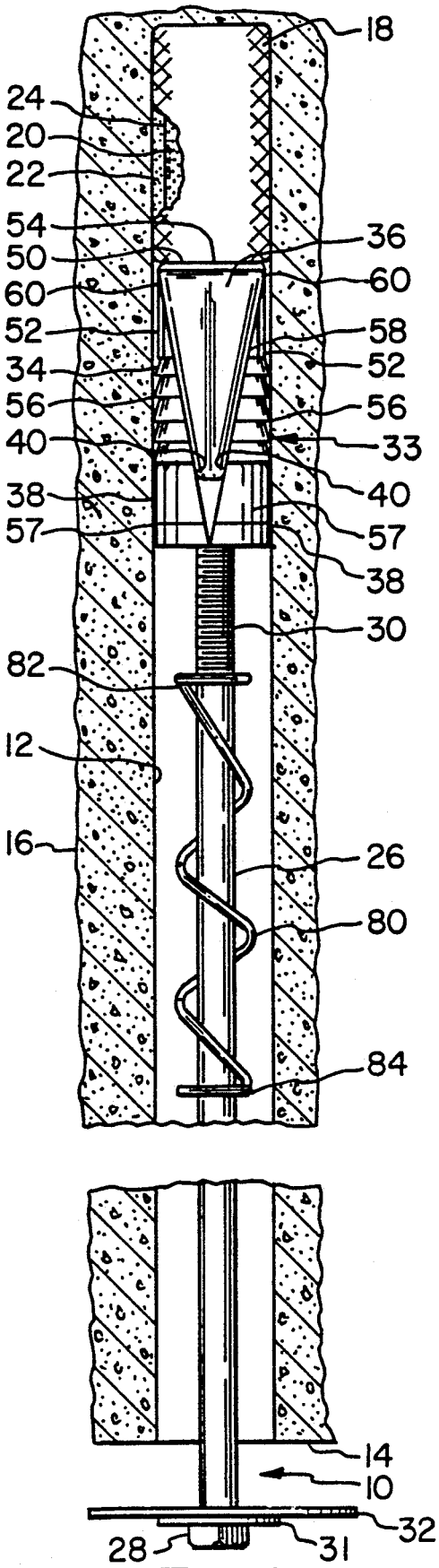
FIG. 1 is a side elevational view, partially in section, showing a rock formation having a bore hole with a roof bolt assembly in accordance with the present invention in place just prior to rupture of a resin cartridge.
Figure 2:
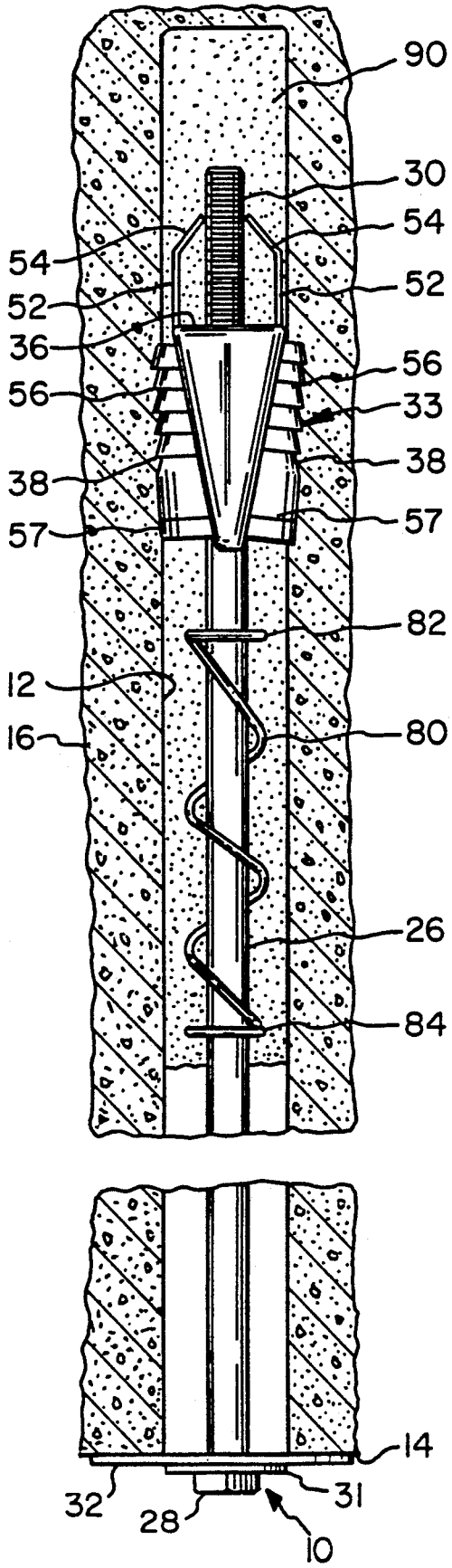
FIG. 2 is a side elevational view similar to FIG. 1 showing the roof bolt assembly as it is finally installed in the bore hole.

Referring now to FIGS. 1 and 2, there is shown a roof bolt assembly, generally designated 10, in accordance with the present invention. The roof bolt 10 is an elongated member often reaching lengths of three to eight feet or longer. The roof bolt 10 is positioned within a bore hole 12 which is drilled upwardly through a generally horizontal mine roof surface 14 and into the rock formation 16 above the mine entry.

A quick-setting resin cartridge 18 is positioned in the blind or upward end of the bore hole 12. The resin cartridge 18 is basically an enclosed, elongated tube which includes two components, an active agent 20 and a reaction agent 22 of a resin grouting mix, separated by a membrane 24. The active agent of a commonly available resin cartridge includes a polyester resin as the major component. The reaction agent is typically a catalyst or curing or hardening agent. The two components 20, 22 of the resin cartridge 18 remain in a semi-liquid or thixotropic phase until mixed, whereupon the resin begins to quickly solidify. Curing and solidification continue until an extremely strong bond is formed by the resin grout. While reference has been made to a "resin" cartridge, it is to be understood that any of the resin systems, adhesive systems, cementitious systems, grouting systems, and the like which are known and used in the art can be used in the present invention, and are meant to be encompassed by the term "resin" However, polyester or other resin cartridges are preferred for use with the roof bolt assembly 10.

The roof bolt assembly 10 includes an elongated bolt shaft 26 with a head 28 on one end and with threads 30 at the other end. The head 28 of a mine roof bolt can be any shape but is typically square.

A two-faced friction reducing washer 31 is positioned immediately above and rests upon the head 28. The friction reducing washer 31 improves the torque/tension relationship of the mine roof bolt 10 whereby for a given torque the bolt will be tensioned at a higher value, which, in turn, places the mine roof 14 at a higher compression force value. This decreases the likelihood of a mine roof failure. A support plate 32 rests upon washer 31, with the support plate 32 and head 28 sandwiching the washer 31 therebetween.

Preferably, the washer 31 has a hardened steel core with a dry lubricant coating formed of a dry lubricant suspension on both faces of the washer. Specifically, the dry lubricant suspension is a graphite suspension in a resin-based system of 30%–50% suspended solids by weight. A particular coating that we have found to work extremely well is Grafo 231-5, manufactured by Grafo Colloid Corporation, Sharon, Pa. 16146. For a standard mine roof washer, the coatings have been on the order of several thousandths of an inch thick. Of course, the coating thickness depends upon the amount of lubrication desired.

A bail-type mechanical anchor 33 is carried on the threaded end 30 of the bolt shaft 26. Bail-type mechanical anchors per se are known as shown, for example, in U.S. Pat. Nos. 2,952,129 and 4,483,645. The bail-type mechanical anchor 33 includes a two-part expansible anchoring shell 34 and a wedged-shaped nut 36. The shell 34, which normally is generally circular in transverse section and of a diameter only slightly less than that of the bore hole 12, has two diametrically-opposed parts 38, each part being formed as a longitudinal segment of a cylinder and having upwardly divergent tapering longitudinal plane edges 40.

The smaller upper ends of the two parts 38 of the shell 34 are connected together by a band-like connecting member 50 that is substantially U-shaped. The opposed parts 38 are connected to each other only by connecting member 50. The connecting member 50 has two legs 52, which are normally generally parallel to each other and extend longitudinally of the shell 34, and a base 54, which extends transversely of the shell 34 somewhat above the upper ends of the two shell parts 38. The legs 52 of the connecting member 50 may be secured to the shell parts 38 in any appropriate manner, but preferably they should be pinned and crimped as is well known in the art. The curved outer surfaces of the shell parts 38 preferably are provided with a plurality of step-like circumferential serrations 56 for embedding and gripping engagement with the side walls of the bore hole 12. Vertical serrations 57 are provided on the curved outer surfaces of the shell parts 38 below the serrations 56. The wedge 36 is threaded on the threads 30 of the bolt shaft 26 and is disposed between the two shell parts 38 and has plane wedging surfaces 58 complementary to and in mutually-wedging engagement with each pair of the opposed side plane edges 40 of the shell parts 38. The exterior surfaces of the wedge 36 between its wedging surfaces 58 are arcuate to correspond to the circular periphery of the shell 34. At its larger end, the wedge 36 has longitudinal channels or grooves 60 to accommodate the legs 52 of the connecting member 50 passing thereby.

The roof bolt 10 further includes a separate mechanism connected to the roof bolt 10 for mixing the two components 20, 22 of the resin cartridge 18 after it has been ruptured. Specifically, there is shown in FIGS. 1 and 2, a helical coil 80 which is separate from and surrounds the bolt shaft 26, and extends downward in the annulus between the rock formation 16 and the bolt shaft 26. The upper end 82 of the helical coil 80 is connected to the bottom of the threads 30. In the preferred embodiment shown in FIG. 1, the upper end 82 of the helical coil 80 forms a loop which surrounds and is loosely crimped to the bottom of the threads 30 below the shell 34. A lower end 84 of the helical coil 80 may be affixed securely to bolt shaft 26 or may hang freely in the annulus between the rock formation 16 and the bolt shaft 26.

The operation of roof bolt assembly 10 in accordance with the present invention can be explained with reference to the figures. Initially a resin cartridge 18 is placed in the bore hole 12 above the roof bolt 10 and then the roof bolt 10 is advanced upwardly into the bore hole 12. FIG. 1 shows the arrangement just prior to the rupture of the resin cartridge 18. The roof bolt 10 then continues to advance into the bore hole 12 and ruptures the resin cartridge 18. At the same time, the components 20, 22 of the ruptured resin cartridge 18 are forced downward from the upward displacement of the anchor assembly.

The bolt head 28 and, hence, the entire bolt shaft 26, is rotated continuously in one direction and is drawn upward until the support plate 32 and the washer 31 are compressed between the mine roof surface 14 and the bolt head 28. Continued rotation draws the bail-type anchor 33 downward until an upper end of the bolt shaft 26 comes into contact with the base 54 of the connecting member 50. Thereafter, the wedge 36 is further drawn down, independent of the expansion shell 34, so as to force shell parts 38 outwardly into engagement with the bore hole wall. Further rotation causes the connecting member 50 to subsequently break as shown in FIG. 2. Rotation of the roof bolt 10 is continued until the proper tensioning force is reached. If the roof bolt 10 includes a friction reducing washer 31, the bolt 10 will be more efficient than previous bail-type roof bolts. Therefore, a higher percentage of the torque will be converted into tension force onto the bolt 10. Accordingly, the wedge 36 will travel down the bolt threads 30 more so than in the prior art and, therefore, the threaded length below the wedge 36 should be increased to a substantial length so that the roof 14 can be placed in higher compression. A $\frac{3}{4}$ diameter mine bolt having $1\frac{1}{2}''$ of the threaded length positioned below the wedge 36, and made in accordance with the invention, achieves excellent results. If the threaded bolt distance is not increased, then the advantage of the friction reducing washer 31 may not be realized in a soft anchorage horizon.

While the roof bolt 10 is being rotated, the helical coil 80 is simultaneously being rotated. The resin components 20, 22 were previously forced downwardly to the vicinity of the helical coil 80 when the bolt 10 was advanced upwardly, and the action of rotating the helical coil 80 violently mixes resin components 20, 22 together and continually urges or forces the resin components 20, 22 upwardly. It is thus insured that the resin components are thoroughly mixed together and completely fill the annulus surrounding the upper portion of the roof bolt 10. The final curing of the resin to its ultimate rigid condition occurs after the rotation of the bolt 10 has stopped. Ideally, a substantial portion of the helical coil 80 will be embedded in the resin, but the exact proportion so embedded will depend on the resin cartridge 18, the porosity of the surrounding rock formation 16 and the exact diameter of the bore hole 12 and the bolt shaft 26. The configuration of the roof bolt 10 in place with the cured resin 90 surrounding is shown in FIG. 2.

It can be seen that the use of the helical coil 80 for continually mixing the resin components 20, 22 provides for a strong cured resin since it is thoroughly mixed. Furthermore, strength is added to the assembly because the resin is continually forced upward and reduces the chances of air pockets or gaps forming in the annulus between the bolt shaft 26 and the rock formation 16. Additional strengthening is added by the helical wire being embedded in the cured resin 90. Moreover, this roof bolt assembly 10 is easy to install, requiring only continuous rotation of the bolt after it has been inserted into the bore hole 12. The use of the bail-type anchor permits the assembly to remain secured to a bore hole in any type of rock formation, including soft strata.

Having described presently the preferred embodiments of this invention, it is to be understood that it may be otherwise embodied within the scope of the following claims.

We claim:

1. A mine roof anchor assembly in combination with a quick-setting resin cartridge inserted into a mine roof opening, the anchor assembly comprising:

(a) an elongated bolt having a head at one end and threaded for a portion of its length at the other end;

(b) a bail-type mechanical anchor carried on said threaded end of said bolt, said anchor including an expansion member having diametrically opposed parts and a connecting member for connecting said opposed parts to each other wherein said opposed parts are only connected to each other by said connecting member, said connecting member having spaced legs and a base, with lower ends of each of said legs connected to a respective upper portion of said opposed parts, and with said base joining upper ends of said legs, and a wedge member threadedly engaged with said elongated bolt between said legs of said connecting member and said opposed parts of said expansion member, whereby said wedge will force said opposed parts outwardly with respect to longitudinal movement thereof as (c) a bearing plate having a central opening and positioned on said bolt to engage with a face of the rock formation;

(d) a two-faced washed having a lubricant coating on a face of said washer positioned on said bolt between said bolt head and said bearing plate, said elongated bolt having a threaded portion extending a distance substantial enough below said mechanical anchor toward said bolt head to improve the compression of the mine roof through the advantage of the lubricating surface of said two-faced washer; and (e) an elongated helical coil having an upper end attached to said bolt and positioned external of and surrounding a substantial length along said bolt and positioned below said mechanical anchor, said coil having a direction of coil so as to urge resin upwardly towards said threaded end while said wedge moves downwardly and while said bolt is rotated in one continuous direction to achieve mixing of the resin and to secure the mechanical anchor to the rock; and whereby the quick-setting cartridge is ruptured by said base of said bail when it is forced upwardly into the mine roof opening thereby permitting the resin to gravitate downwardly between said wall of the opening and said bolt; wherein rotation of said bolt causes said wedge to move down said threaded end of said bolt and causes said opposed parts of said expansion member to move outwardly and secure into the bore hole wall.

2. The anchor bolt assembly of claim 1, wherein the helical coil is formed in the shape of a loop which surrounds and is crimped to the bolt at the base of said bolt threads.

3. The anchor bolt assembly of claim 2, wherein said coil loop is loosely crimped to said bolt whereby when said wedge comes into contact with said crimped coil, said coil becomes uncrimped so as not to impede longitudinal movement of said wedge.

4. The anchor bolt assembly of claim 1, further including a coating formed of a dry lubricant suspension on both faces of said washer.

5. The anchor bolt assembly of claim 4, wherein said dry lubricant is graphite.

6. The anchor bolt assembly of claim 4, wherein said coating is a graphite suspension in a resin-based system.

7. The anchor bolt assembly of claim 6, wherein said graphite coating is a graphite suspension in a resin base having about 30%–50% suspended solids by weight.

8. The anchor bolt assembly of claim 4, wherein said washer has a hardened steel core.

9. The anchor bolt assembly claimed in claim 1 wherein said threads extend 1½" below said wedge member.

* * * * *

UNITED STATES PATENT AND TRADEMARK OFFICE

CERTIFICATE OF CORRECTION

PATENT NO. : 5,042,961

DATED : August 27, 1991

INVENTOR(S) : Ralph F. Scott and Frank M. Locotos

It is certified that error appears in the above-identified patent and that said Letters Patent is hereby corrected as shown below:

Front page, under References Cited U.S. PATENT DOCUMENTS insert
--2,952,129 9/1960 Dempsey ... 405/261
4,483,645 11/1984 White et al. ... 405/261
4,655,645 4/1987 Hipkins, Sr. et al. ... 405/261--.

Column 4 Line 51 "3/4" should read --3/4"--.

Claim 1 (b) Line 50 Column 5 after "as" insert
--said bolt is rotated;--.

Claim 1 (d) Line 1 Column 6 "washed" should read --washer--.

Signed and Sealed this

Eighth Day of June, 1993

Michael K. Kirk

*Attest:*

MICHAEL K. KIRK

*Attesting Officer*

*Acting Commissioner of Patents and Trademarks*